US006056159A

United States Patent [19]

Layer

[11] Patent Number: 6,056,159

[45] Date of Patent: May 2, 2000

[54] HOLDER FOR FULL OR FOLDED COLLAPSIBLE TUBES

[76] Inventor: Robert Wesley Layer, 4621-A Cox Dr., Cuyahoga Falls, Ohio 44224

[21] Appl. No.: 09/253,721

[22] Filed: Feb. 22, 1999

[51] Int. Cl.[7] ..... B65D 35/56

[52] U.S. Cl. ..... 222/105; 248/109

[58] Field of Search ..... 222/105; 248/109

[56] References Cited

U.S. PATENT DOCUMENTS

| | | | |
|---|---|---|---|
| 2,190,567 | 2/1940 | Jung | 248/109 |
| 4,976,380 | 12/1990 | vonSchuckmann . | |
| 5,553,819 | 9/1996 | Smajdek . | |
| 5,673,880 | 10/1997 | Dexter, Jr. | 248/109 |
| 5,799,910 | 9/1998 | Dexter | 248/109 |

*Primary Examiner*—Philippe Derakshani

[57] ABSTRACT

A combination of a compact, economical, decorative, rigid, one-piece holder and a squeezable collapsible dispensing tube, where the holder has a supporting base with a planar bottom standing surface to which are attached two side walls such that their substantially planar inner surface face each other and form a substantially upright V-shaped notch. The dimension of the V-shaped notch, such as its height, its top opening width, and the width of the inner surfaces of the side walls, are such that a sufficient length of the bottom section of a full collapsible dispensing tube fits into and is firmly grasped by the V-shaped notch and is securely held in an upright position. These same dimensions should also be sufficient that a partially-emptied, collapsible dispensing tube, which has been flattened and folded a plurality of time—generally about four or five times for a toothpaste tube—fits into and is securely held upright by the notch of the holder. The firm grasp of the V-notch of the holder on an inserted partially-emptied, flattened, and folded dispensing tube prevents both the tube from unfolding and the product from re-entering the folded section of the tube during use. Because of this, the use of this holder greatly simplfies the process of emptying a product from a tube.

8 Claims, 9 Drawing Sheets

HOLDER FOR FULL OR FOLDED COLLAPSIBLE TUBES

BACKGROUND—FIELD OF INVENTION

This invention relates to a device for holding a squeezable, flexible, collapsible dispensing tube, which may be anywhere from completely full to substantially empty, that is used for dispensing a variety of products such as toothpaste, cream, ointment, glue, paint, and the like.

INTRODUCTION

Many household products, of suitable fluidity, are packaged in squeezable collapsible tubes where the product contained therein is extruded from the tube by manual pressure. However, the use of a collapsible tube has an inherent drawback in that, as more and more of its product is extruded, the tube becomes less full. Now, the product moves both forward toward the nozzle opening at the top of the tube as well as backward to the sealed bottom end of the tube. Consequently, it becomes more and more difficult to extrude the product from the tube. Because of this, the application of manual dispensing pressure on the tube to extrude product becomes less efficient. Typically, to overcome this drawback and prevent product from moving back toward the sealed end of the tube during use, a portion of the bottom end of a partially-emptied tube is flattened and then folded, or rolled up, onto the main body of the tube. In this way, the crease of the fold, if maintained, becomes the new bottom of the tube and prevents product from flowing back into the flattened portion of the tube. Unfortunately, this maneuver does not solve the problem as applying manual dispensing pressure on a folded flexible tube causes the folded, but unrestrained, segment of the tube to unfold. This is especially true for most tubes which today are made of flexible plastic and elastomeric materials. Because of their elasticity, these tubes readily revert to their more unstressed unfolded configuration when dispensing pressure is applied. This means that a collapsible tube must constantly be reflattened and refolded during use. Since this is very inefficient, time consuming, and frustrating, a great need exists for a simple, economical, and an easy-to-use device that prevents a folded collapsible tube from unfolding to a more unstrained configuration during use.

Besides ease of use, equally important are considerations of appearance and cleanliness. Collapsible dispensing tubes containing products that are used frequently, such as toothpaste tubes, are commonly left on sink and counter tops in plain view when not in use. Such partially-emptied and perhaps partially-folded tubes are not visually attractive, especially in today's home where esthetics are major considerations. Moreover, tubes, such as toothpaste tubes, usually become even more unattractive during use as layers of unintentionally extruded excess toothpaste commonly builds up on the nozzle and cap. Not only is this unattractive, but it also requires extra time to clean the tube. Currently, probably the most common way to avoid having unsightly toothpaste tubes lying about is to inconveniently store them out of sight, such as in cabinets and draws. However, even this only hides the cleanliness issue associated with the unintentionally extruded excess product. Thus, it can be seen, there is an even greater need for an economical collapsible tube holder that not only makes it easier to extrude products from the tube but also one that helps keep the nozzle and cap clean and allows a frequently used tube to be stored cleanly, neatly, and attractively in plain view.

A variety of devices have been proposed for holding a collapsible tube, as well as for assisting in dispensing its contents, that eliminates the need to constantly reflated and refold a partially-emptied tube. However, none of these devices have achieved widespread commercial acceptance. Thus, a simple economical solution to this problem is still greatly needed.

DESCRIPTION OF PRIOR ART

Numerous devices with a hollow cylindrical inner core into which a collapsible tube can be inserted are commonly used to hold a collapsible tube in a more or less upright position. For example, tumblers, mugs, and the like are used for this purpose. There are various modifications of this type of holder. One such modification is shown in U.S. Pat. No. 2,190,567 to Jung (1940) which describes a holder used to support full tubes for display purposes. In this modification, which allows a tube to easily be viewed, a large section from the upper portion of the front of the cylindrical inner core is removed. Furthermore, the remaining inner concave wall of the back portion of the cylinder, which conforms to the oval shape of an full oval collapsible tube, is tilted slightly backwards to compensate for the loss of the front wall. The walls of the remaining smaller, lower, inner core portion of the holder are concave and tapered rather than fully cylindrical to conform to the tapered shape of the bottom of a collapsible tube. This anchors the bottom of a tube and prevents it from sliding. In this way, the combination of the supporting, oval, inner, upper back wall and the tapered, inner lower walls of the holder holds a tube in a substantially upright position for easy viewing. At the same time a tube is easily inserted or removed from the holder as needed. These devices are not claimed to be used to prevent rolled sections of partially emptied tubes from unrolling. Nor are these devices used to hold a tube while product is being extruded from the tube.

Other modifications of cylindrical, inner, hollow, center core type holders overcome these shortcomings. For example, Dexter in U.S. Pat. No. 5,673,880 (1997) describes a cylindrical, inner, hollow, center core type holder which allows product to be extruded from a tube held upright in the holder and which also prevents a partially emptied and rolled tube from unrolling during use. In this cylindrical, center-core type of holder, the inner concave walls of the upper portion of this holder conform to the shape of the full oval section of a collapsible tube and support the tube in an upright position. The inner walls of the lower portion of the hollow section of the holder remain concave as they taper down and become conical. Wide rectangular shaped opposing slots are cut out of opposite sides of the walls of the upper portion of the holder. These allow access for the fingers to extrude product from the tube. The rectangular slots converge and become V-shaped or parabolic as they are extended down through the lower inner portion of the holder. These grasp the wider rolled section of a partially emptied collapsible tube inserted into this cylindrical type holder and them from unrolling during use. A disadvantage of this holder is that, since the upper inner concave walls of the holder are needed to support the tube, a number of different size holders are needed for different size tubes. Another disadvantage of this holder is that the upper cylindrical holding portion of the holder hinders access to the tube for extrusion of product. Since access is limited to the wide rectangular shaped slots in the supporting upper walls of the holder, the holder must be oriented in specific directions for the product in the tube to be easily extruded.

Dexter in U.S. Pat. No. 5,799,913 (1998) further modifies the above holder (U.S. Pat. No. 5,676,880) by including progressively lower recessed shelves in the conical, tapered lower portion of the inner center core of the holder. This modification provides a means of holding non-traditional shaped tubes, such as cylindrical shaped toothpaste tubes.

Devices have been proposed that hold a flexible collapsible tube in the upside-down position, which is with the cap and nozzle facing down, to facilitate the extrusion of its product as well as to simply hold the tube while not in use. Such upside-down holding devices are shown, for example, in U.S. Pat. Nos. 2,474,080 to Witte (1949), 3,446,468 to Sakwa (1969) and 4,203,567 to Featherstone (1980). All of these upside-down holding devices have a number of shortcomings. For example, they are not particularly desirable based on their appearance since they are rather large and must be attached to and protrude from some surface, such as a wall or cabinet. More importantly, because of gravity, the manual pressure used to dispense products from a tube held in this upside-down position promotes the extrusion of excess unwanted product. This is not only wasteful but it also makes it difficult to keep the nozzle and cap of the tube clean. Again, because of gravity, the cap needs to be reapplied to the nozzle of the tube almost immediately after the desired amount of product is extruded to prevent excess product from flowing out of the nozzle and soiling the surface area directly beneath it.

More frequently, devices have been proposed that utilize the combination of an exterior housing designed to hold the tube in place along with a movable section that applies the pressure to the tube to facilitate the extrusion of the product, such as a movable plate, roller, key, gear, and the like. With these devices, the movable section not only applies the pressure to extrude the product, but it also prevents products from flowing back into the emptied portion of the tube. Such devices are shown, for example, in U.S. Pat. Nos. 2,457,024 to Arp (1945), 2,656,069 to Fogarty (1949), 3,910,460 to Hausmann (1975), 4,570,828 to Wood (1986), 4,576,314 to Elias (1983), 4,607,763 to Wright (1986), and 4,978,034 to Vishnevetsky (1990). These devices have a number of disadvantages. Many of these devices hold the collapsible tube in an upside-down position and, consequently, suffer from the same disadvantages associated with tubes held in this upside-down position cited above. The movable section of these devices, which applies pressure to the tube to extrude the product, is difficult to control and promotes the extrusion of excess unwanted product. Furthermore, these devices are neither simple to manufacture nor to keep clean due to the more intricate nature of their movable section.

Yet other devices are proposed for use to assist a collapsible tube dispense the product contained therein, while at the same time preventing the flow of a product back into the flattened bottom end of the tube, when extrusion pressure is applied. These devices utilize a pair of facing, flexible, expandable, and resilient pressure members that are connected together in such a manner as too gradually narrow from a relatively wide opening at the top that allows the tube to fit into the device, to a narrow open slot at the bottom of the device that is just wide enough to allow the emptied, flattened portion of the tube to pass through. When manual pressure is applied to these flexible members to extrude the desired amount of a product from the nozzle, the narrow width of the slot prevents products from flowing back into the emptied and flattened length of the tube that has passed through the slot. Such devices are shown in U.S. Pat. Nos. 2,390,314 to Massey (1945) and 5,222,629 to Tal (1993). These relatively simple devices are designed to assist in the extrusion of product from a collapsible tube and to prevent product from flowing back into the emptied portion of the tube. However, they are not proposed to be used as holders for a tube. Instead, they are added as an appendage to a tube and are usually left on the tube until it is emptied. Because of this, they do little to improve the appearance of a tube, such as a toothpaste tube, that is stored in plain view on sink and counter tops. Since these devices do not hold a tube, they inconveniently require the use of two hands to extrude product from the tube. Furthermore, these devices contain a slot that is just wide enough to allow only the flattened end of a tube to pass through. Thus, a variety different devices are needed for tubes made with different wall thicknesses.

Shown in U.S. Pat. No. 4,976,380 to von Schuckmann (1990) is another device which utilizes a pair of facing, flexible, expandable, and resilient pressure members, or squeezing jaws, that are connected together in such a manner that a tube can be inserted between them. The squeezing jaws, at their bottoms, are connected to a narrow, open, fixed-size slot that is just wide enough to allow the emptied and flattened portion of the tube to pass through. Additionally, the bottom of the open, fixed-size slot is attached to a supporting hollow base that enables the device to hold a tube in an upright position. A disadvantage of this fixed-size slot device, which is the same as those for the fixed-size slot devices described in the previous paragraph, is that each device can only be used for tubes having the same wall thickness. Another disadvantage is that the hollow base, which acts as a receiving chamber for the emptied flattened tube, increases its top-heaviness and decreases its stability. Thus, this device needs to be undesirably larger and/or heavier to improve its stability compared to a device with a solid base. Because the von Schuckmann device utilizes flexible squeezing jaws and a fixed-size open slot, it could be difficult to manufacture economically, such as by molding or extruding. Similarly, both the flexible squeezing jaws and the fixed-size slot are subjected to severe stresses during use which could decrease the service life of the device.

Further, U.S. Pat. No. 5,553,819 to Smajdek (1996) teaches the use of a reusable clip device having a base and side walls forming a receiving chamber into which the entire flattened and folded portion of a tube is inserted. The narrow gap of the slot at the top of the chamber of the clip snugly, but not necessarily extremely tightly, holds the flattened portion of a partially-emptied tube. However, this snug fit at the top of the clip, along with the flattened, folded, or rolled, emptied portion of the tube that is confined within the body of the clip, creates resistance to the rearward flow of product when manual pressure is applied to the unflattened portion of the tube. This inhibits product from re-entering the flattened portion of the tube held in the chamber of the holder. Although this device is simple, it has a number of limitations and drawbacks. One drawback of this device is that it is proposed to be used with a hook attached to the bottom of the base that holds the clip and tube in an upside-down position. The disadvantages of upside-down holders have been described earlier. Furthermore, this device is not designed to hold a tube in the desirable upright position. This stems from the fact only the snug, but not necessarily extremely tight, grasp by the narrow gap at the top of the clip holds and supports the tube. Thus, when even a relatively small amount of product is extruded from a tube, the tube will become weak at its narrowest point, which is just above where it is grasped by the gap of the top of the clip, and sag at this point. Because of this, a tube will only be held upright if it is constantly removed from the holder, reflattened, refolded, and replaced in the holder. A further drawback of this device is that the folded, or rolled, tube must inconveniently be inserted totally into the chamber of the clip from the side.

SUMMARY

The present invention comprises a combination of a simple, compact, economical, decorative, reusable, easy-to-clean holder, containing no movable parts, and an elongated, flexible, collapsible dispensing tube. The holder utilizes an essentially upright V-shaped notch incorporated onto a stabilizing base to securely hold a squeezable collapsible tube containing product in an upright position when a sufficient length of the bottom portion of such a tube is inserted into the V-shaped notch of the holder. The tube, when held in the holder of this invention, can conveniently be held in an upright position even after a considerable portion of its product has been conveniently and cleanly extruded from the tube by applying manual pressure toward the top portion of the tube. However, at some point, the tube sags when enough product has been extruded. Never-the-less, the tube is easily returned to its upright state by removing it from the holder, flattening, folding, and then replacing it in the holder. In the holder, when manual extrusion pressure is applied to a folded tube, the fold is prevented for unfolding and no product re-enters the folded portion of the tube. This greatly reduces the number of times that the tube has to be flattened during the process of completely emptying a tube, such as a toothpaste tube. Using this holder, a toothpaste tube can be completely emptied using only about four flattenings and foldings. Because the holder of the present invention maintains the tube in an upright position, its product can be easily, efficiently, and precisely extruded from the tube using only one hand. Similarly, the gravitational effect on the upright tube helps prevent excess product from being extruded and accumulating on the nozzle and cap of the tube.

OBJECTIVES AND ADVANTAGES

Several objectives and advantages of the present invention are:

(a) to provide a compact, rigid, one-piece, inexpensive, easy-to-use, collapsible dispensing tube holder, containing no moving parts, that eliminates the need to perpetually reflattened and refold a partially-emptied tube;

(b) to provide a compact, rigid, one-piece, inexpensive, easy-to-use, collapsible dispensing tube holder containing no moving parts that greatly simplifies the process of essentially completely removing a product from a large variety of various size metallic, plastic, and elastomeric tubes with different wall thicknesses;

(c) to provide a collapsible dispensing tube holder that conveniently holds a full, or partially-emptied, flattened, and folded tube in an upright position as its product is extruded;

(d) to provide a collapsible dispensing tube holder that only requires the use of one hand to uncap, extrude product from, and recap the nozzle of a tube;

(e) to provide a collapsible dispensing tube holder that increases ones control over the amount of product extruded from the nozzle of a tube;

(f) to provide a collapsible dispensing tube holder that helps return excess extruded product back into the nozzle of a tube;

(g) to provide a collapsible dispensing tube holder that prevents product from seeping out a tube when the nozzle of the tube is left uncapped;

(h) to provide a collapsible dispensing tube holder that helps keep the outside of the nozzle and cap of a tube clean and free of product;

(i) to provide a collapsible dispensing tube holding device that allows a tube to be compactly, conveniently, and attractively stored in plain view on sink or counter top;

(j) to provide a collapsible dispensing tube holding device that can be mounted on a wall, so that a tube can be compactly, conveniently, and attractively left in plain view;

(k) to provide a one-piece, collapsible dispensing tube holder with no movable parts that can easily and economically be molded, extruded, cast, stamped or otherwise formed from a variety of materials, such as plastic, elastomer, wood, metal, ceramic, glass, cement, and combinations of materials;

(l) to provide a collapsible dispensing tube holder that can easily and economically be made in various colors to enhance decorative appeal;

(m) to provide a collapsible dispensing tube holder that can easily and economically be made in various shapes and sizes to enhance decorative appeal;

(n) to provide a collapsible dispensing tube holder that can easily be cleaned to maintain a sanitary environment.

Further objects and advantages of this invention will become apparent from a consideration of the ensuing descriptions, drawings, and examples.

DRAWING FIGURES

FIGS. 3A,3B,3C, and 3D are perspective views of examples of various combinations of side wall and base shapes of the holder.

Figure 4:
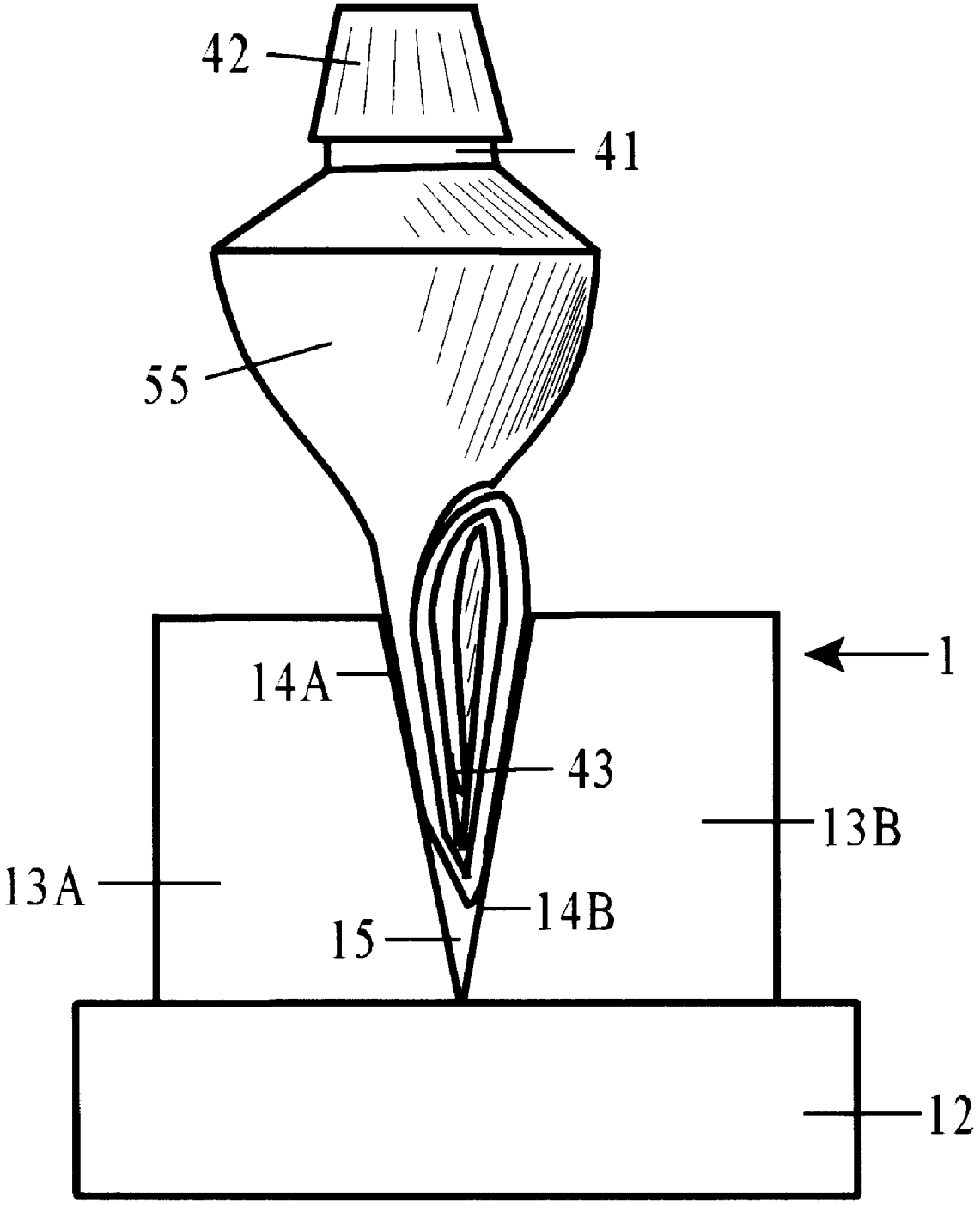

FIG. 4 is a side view of a holding device of this invention holding a squeezable, collapsible dispensing tube that has been flattened and folded four times.

Figure 5:
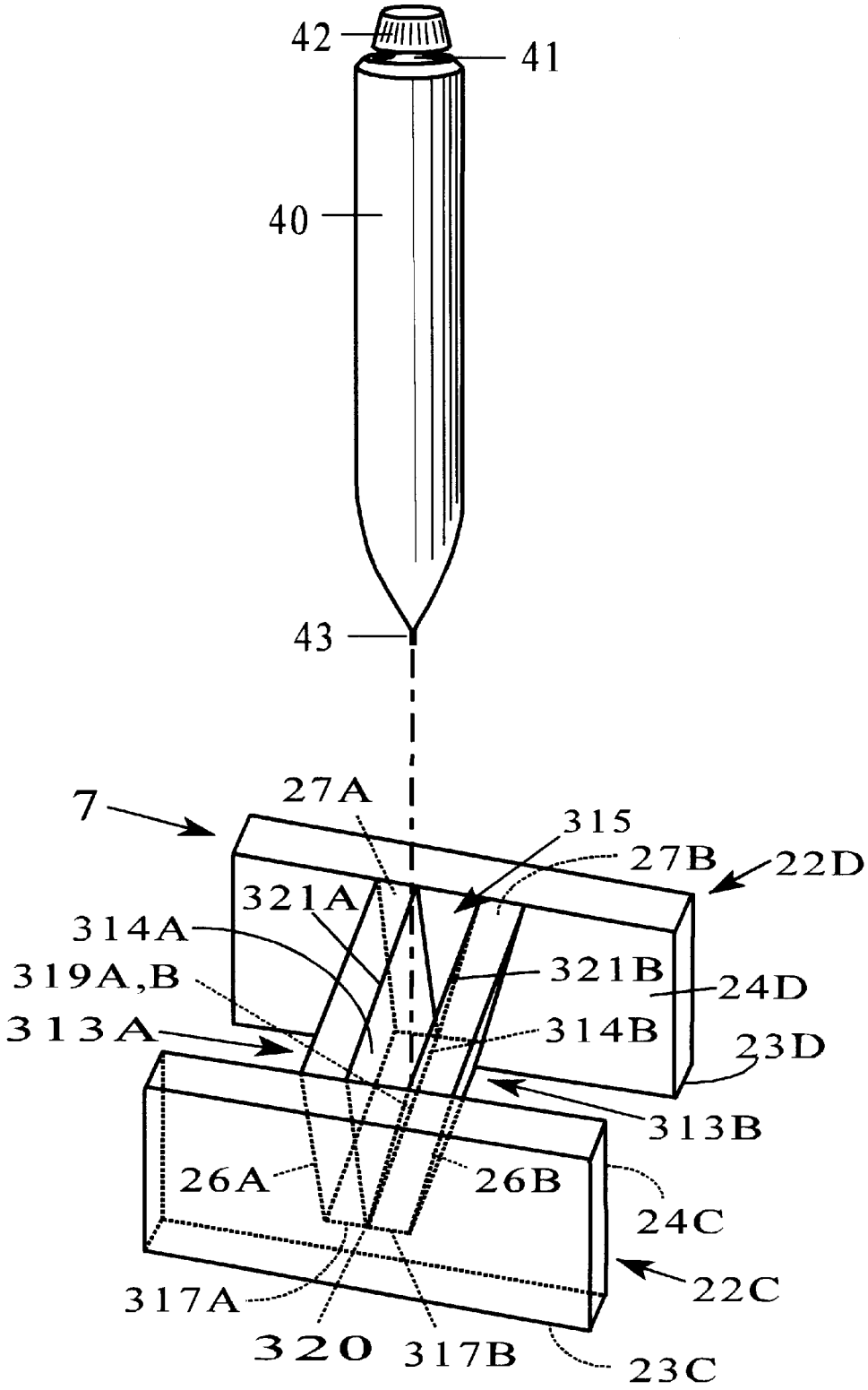

FIG. 5 is a perspective view of a V-shaped notch holder supported on each end by two supporting walls together with a full, squeezable, collapsible dispensing tube.

Figure 6:
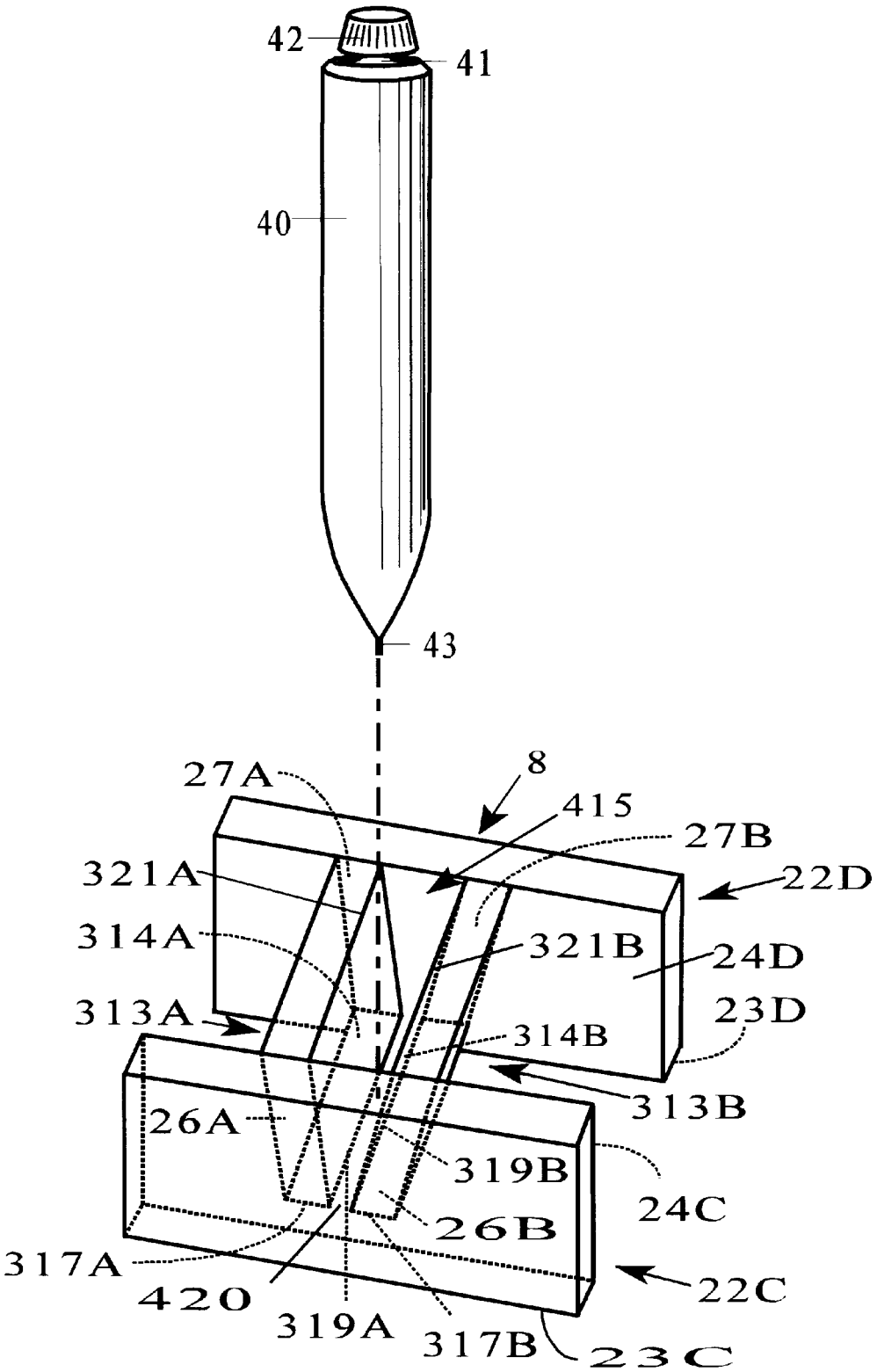

FIG. 6 is a perspective view of a V-shaped notch holder supported on each end by two supporting walls where the valley of the notch is a narrow rectangular open slot together with a full, squeezable, collapsible dispensing tube.

Figure 7:
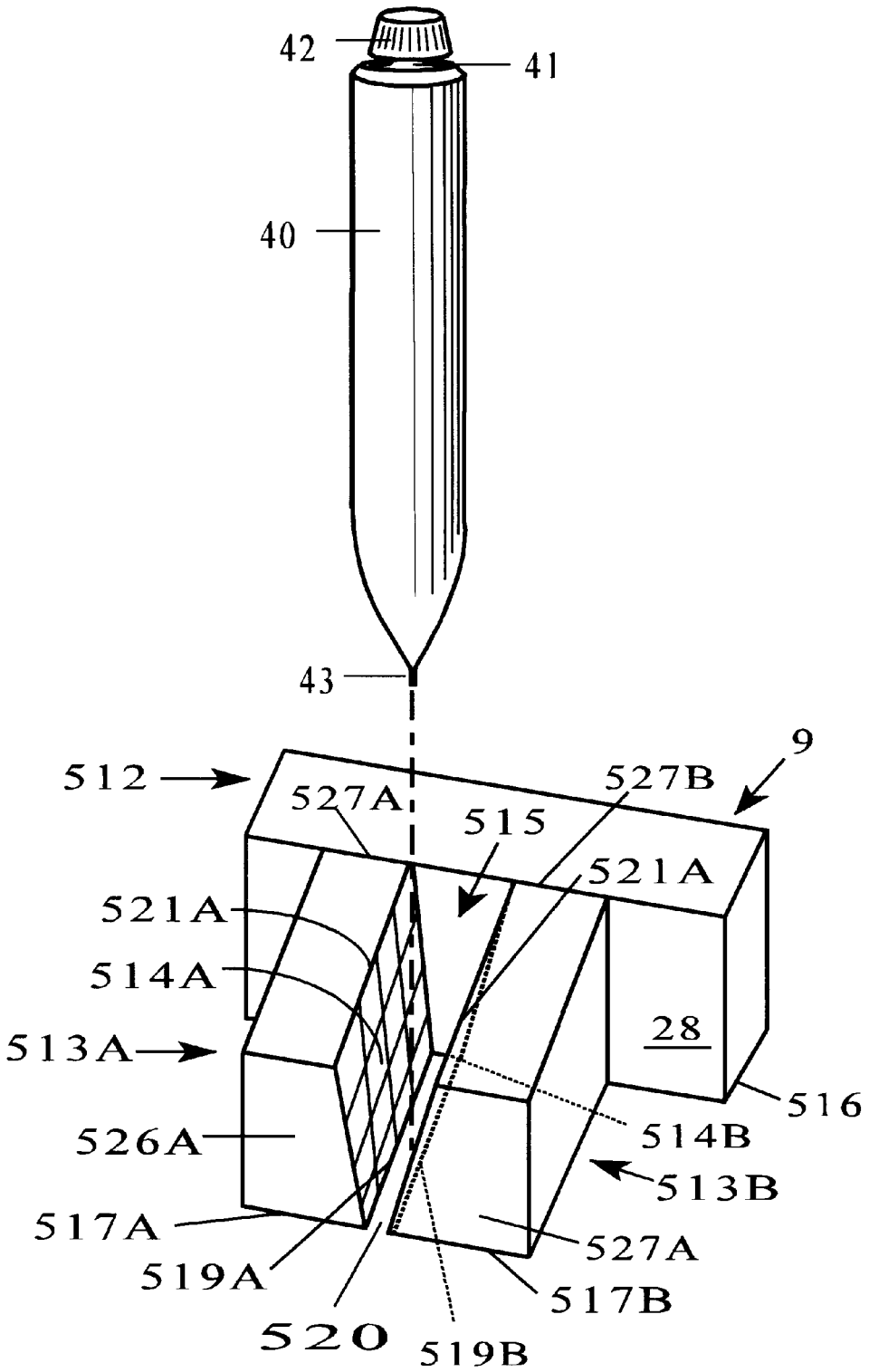
Figure 8:
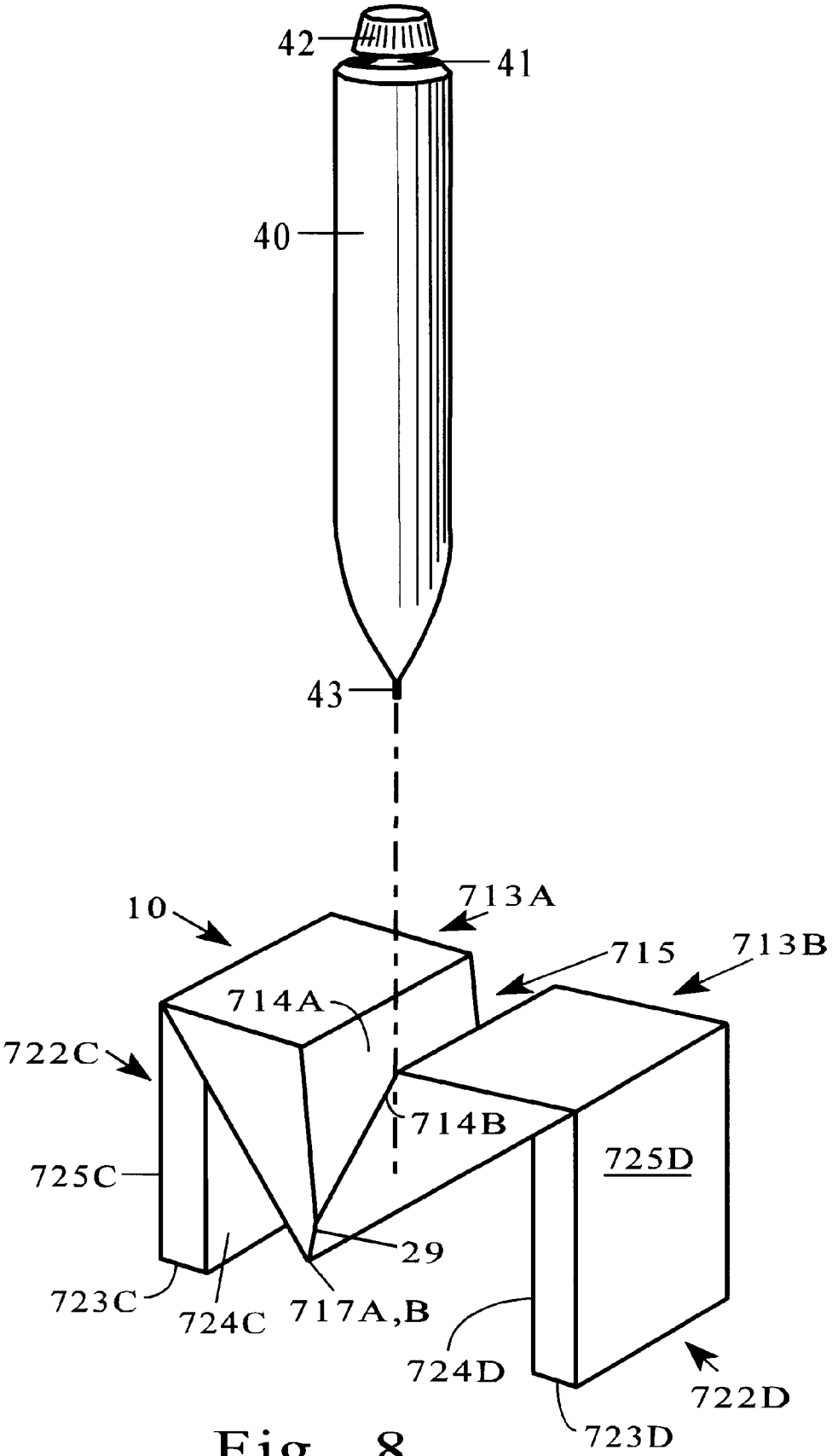

FIG. 7 is a perspective view of a V-shaped notch holder attached on one end of the notch to the side of a supporting base together with a full, squeezable, collapsible dispensing tube FIG. 8 is a perspective view of a V-shaped notch holder supported on each side of the notch by two supporting walls together with a full, squeezable, collapsible dispensing tube.

Figure 9:
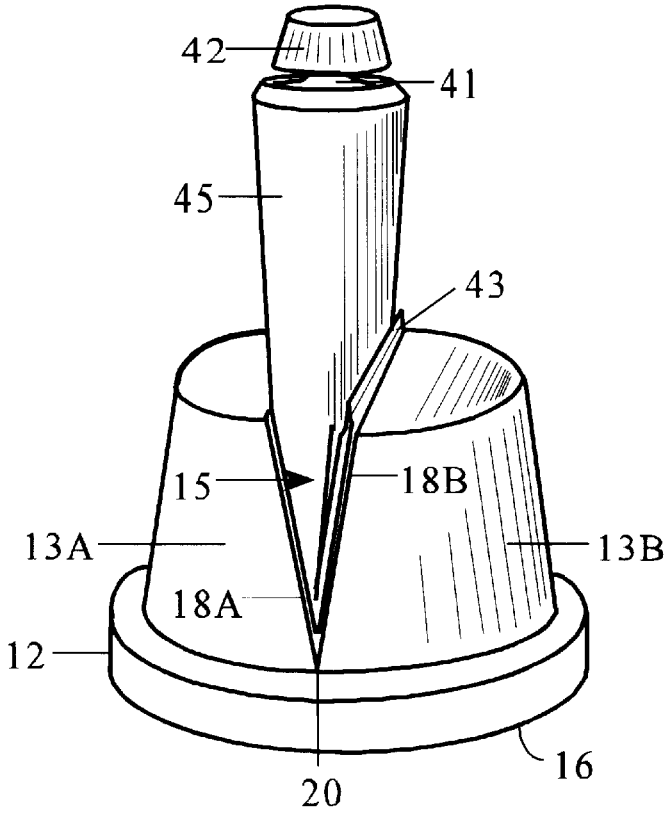

FIG. 9 is a perspective view of a V-shaped notch holder holding a partially-emptied collapsible dispensing tube that has been flattened and folded once.

Figure 10:
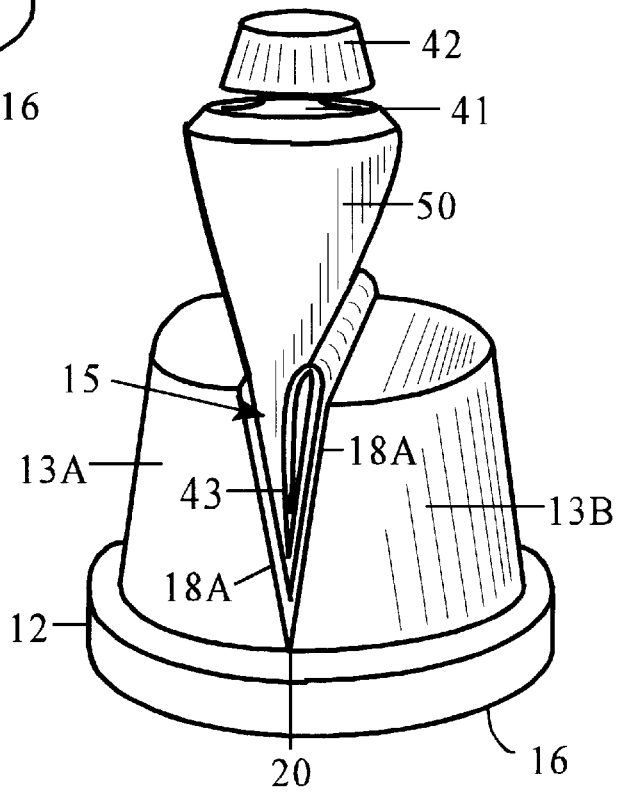

FIG. 10 is a perspective view of a holder holding a partially-emptied collapsible dispensing tube which has been flattened and folded twice.

DETAILED DESCRIPTION OF THE PREFERRED EMBODIMENTS

Figure 1:
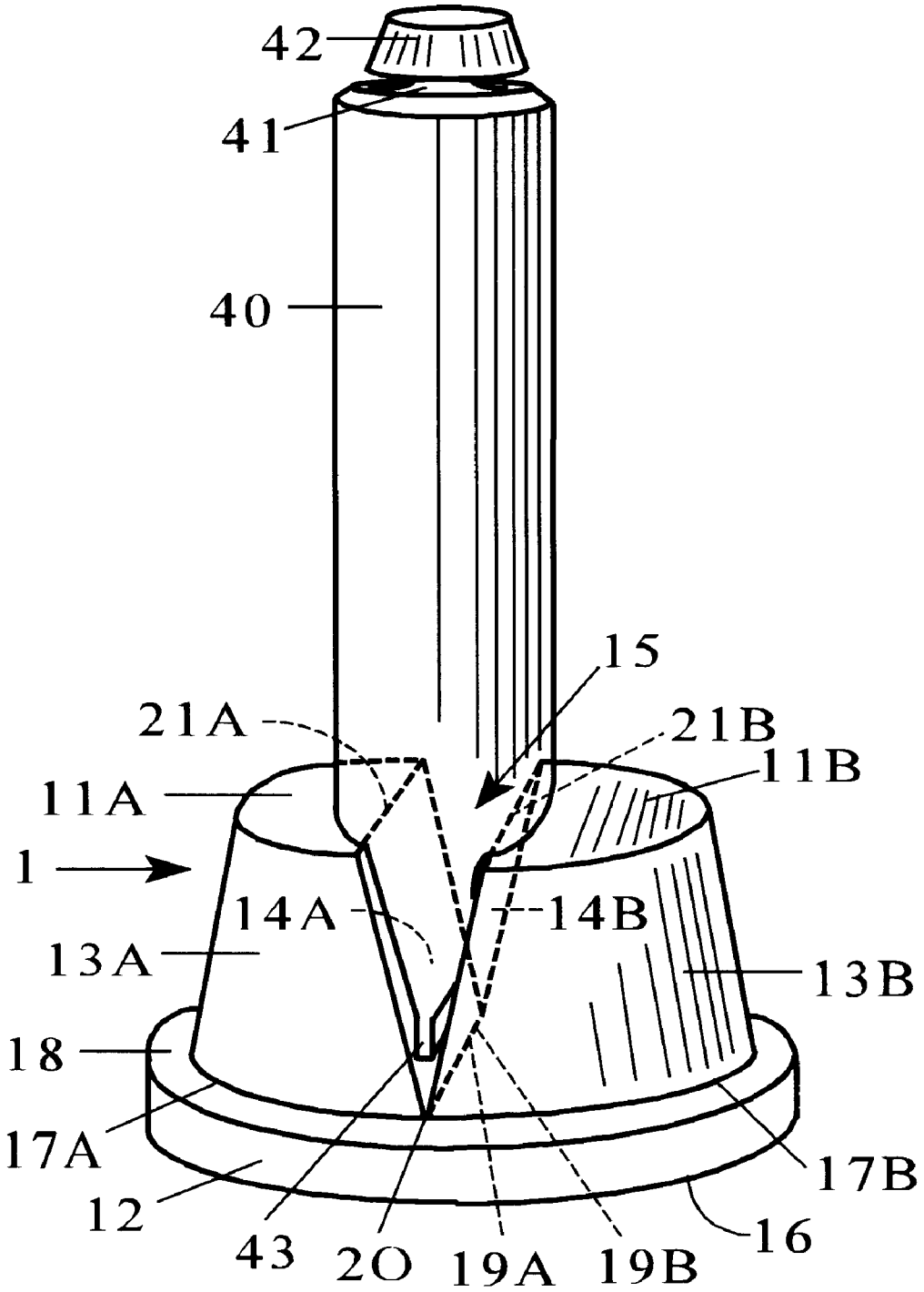
FIG. 1 is a perspective view of a V-shaped notch holding device of this invention holding a full, squeezable, collapsible dispensing tube.
Figure 2:
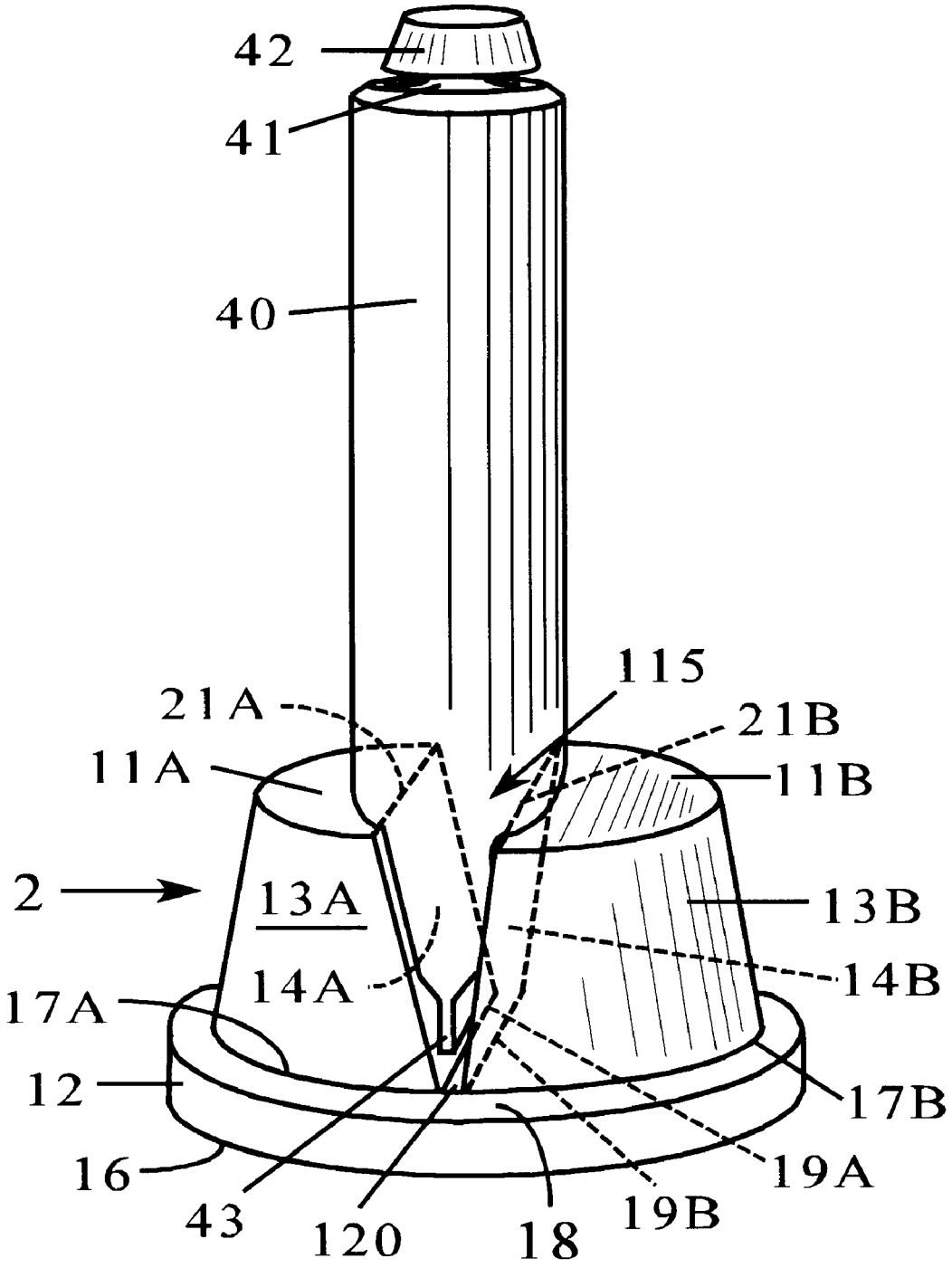
FIG. 2 is a perspective view of a V-shaped notch holding device with a slightly flattened valley of the notch holding a full, squeezable, collapsible dispensing tube.
Figure 3A:
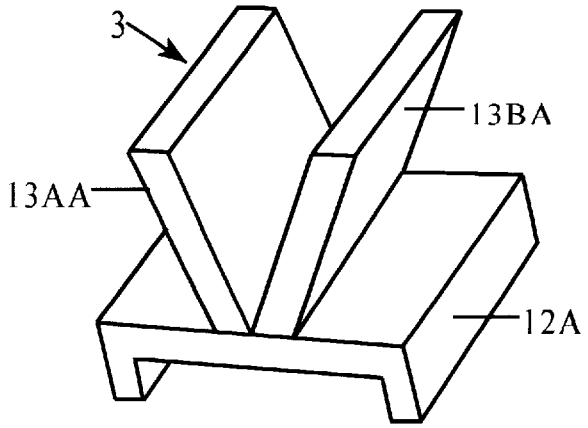
Figure 3B:
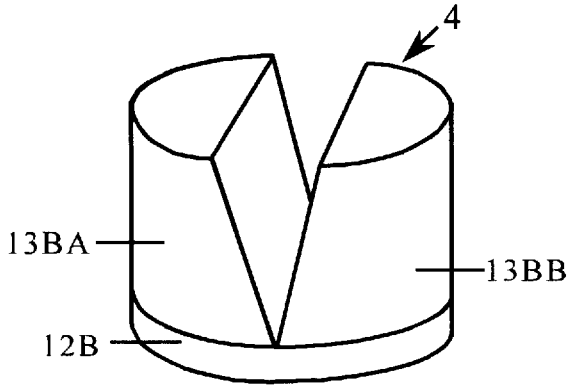
Figure 3C:
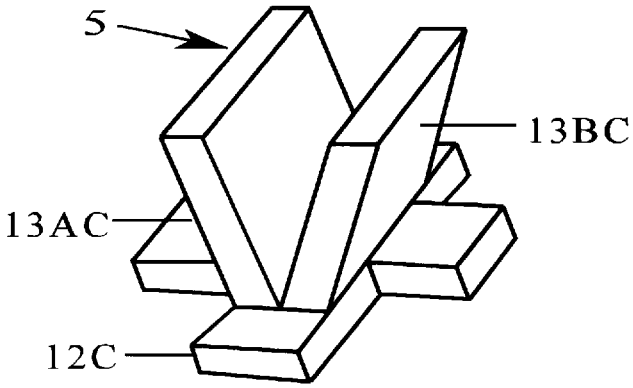
Figure 3D:
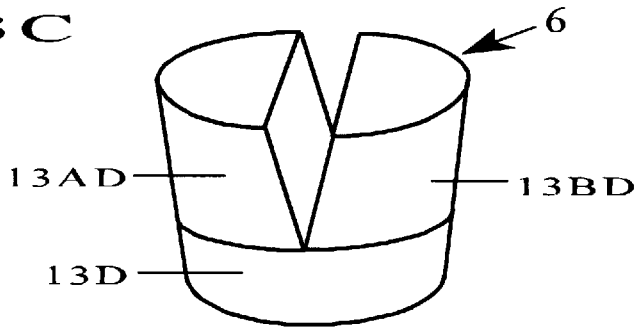

Referring to FIG. 1, a typical embodiment of a holding device of the present invention is illustrated in a perspective view of a holder 1 holding a full, squeezable, collapsible dispensing tube 40 in a substantially upright position. Tube 40 comprising flexible, elastic tubular walls, a nozzle 41 containing a removable cap 42 at one end, defined as the top portion of the tube, and a flat seal 43 at the other end, defined as the bottom portion of the tube. Holder 1 comprising a supporting structure, or substantially rigid base 12, and two side walls 13A, 13B that are aligned such that their substantially planar holding surfaces or inner surfaces 14A, 14B face each other and form a substantially V-shaped notch 15. Base 12 has a planar standing surface, or bottom 16 that lies in a horizontal plane that is essentially perpendicular to the longitudinal axis of an upright full tube 40. So long as base 12 has a planar bottom, it may have any of a variety of shapes and sizes which may contain holes or be hollow, as well as solid. Side walls 13A, 13B, at their bottoms 17A, 17B, are integrally attached to the top 18 of base 12. Planar inner surfaces 14A, 14B of side walls 13A, 13B face each other as if they were mirror images. The planar inner surfaces 14A, 14B, which may be smooth or scored, or otherwise roughened, to improve their holding power, as shown in FIG. 7, have substantially linear bottom edges. Bottom edges 19A and 19B are generally of equal lengths and lie on and preferably near the middle of base 12. Bottom edges 19A, 19B are preferably parallel to each other on a plane that is parallel to planar bottom 16 and are either superimposed on one another, as shown in FIG. 1, or separated from each other by some small predetermined distance, as shown in FIG. 2. As shown in FIG. 1, planar inner surfaces 14A, 14B rise equally from their bottom edges 19A, 19B, separating from each other and equally from an axis that is perpendicular to planar bottom 16 as they rise, to produce a holder 1 with a substantially V-shaped notch 15, whose inner surfaces are substantially the same height, that is open on each side. When bottom edges 19A, 19B are substantially superimposed on each other, notch 15 is V-shaped with a valley 20 that is essentially an acute angle. As shown in FIG. 2, when bottom edges 19A, 19B of inner surfaces 14A, 14B of a holder 2 are separated by a small predetermined distance, say 1 mm to about 4 mm for holding common size toothpaste tubes, the notch 115 is slightly truncated with a slightly wider, flattened valley 120. Advantages of holders with slightly wider valleys of the notch are that they are: 1)—easier to manufacture, 2)—easier to clean the notch, 3)—more durable due to reduced stress on the notch which decreases stress cracking commonly encountered in products made of plastics, such as polyethylene, as they age and become brittle.

As shown in FIG. 1, each planar inner surface 14A or 14B has a top edge 21A or 21B at the top 11A or 11B of each side wall 13A, 13B, respectively, that preferably, but not necessarily, is substantially parallel to bottom 16. The lengths of top edges 21A, 21B of notch 15 may be less than, equal to, or greater than the width of tube 40. Although, generally the top edges are of the same length, they may be of different lengths. Similarly, the length of the valley of the notch may be less than, equal to, or greater than the width of the tube being held. Furthermore, the lengths of the top edges need not be the same as the length of the valley. Although the side walls are integrally attached to the top of the base, the side walls may have a variety of shapes of their own and may contain horizontal holes, or be hollow, as well as solid. Perspective views of some illustrative examples of holders 3,4,5, and 6 with combinations of bases 12A,B,C, D and side walls 13AA/13BA, 13AB/13BB, 13AC/13BC, 13AD/13BD, respectively, of various shapes are shown in FIGS. 3A, 3B, 3C, and 3D.

In the preferred embodiment of this invention, as shown in FIG. 1, the compactness of the holder is very important. Dimensions that allow the holder to be compact and yet firmly grasp and hold a substantially full collapsible dispensing tube securely in an upright position are the widths of the inner surfaces 14A, 14B of the side walls of the notch, the height of the notch, the opening width across the top of the notch, and to a lesser degree the small width of the valley of the notch. The height of the V-shaped notch is measured perpendicularly from valley 20 to the top edge 21A or 21B of notch 15, which preferably is planar and parallel to planar bottom 16. The top opening width across the top of the notch is measured from the top edge 21A or 21B to the opposing side of the notch on line which is parallel to planar bottom 16. These dimension are selected so that a sufficient length of the bottom portion of full tube 40 can be inserted into notch 15 and at the same time be reasonably securely pressed against inner surfaces 14A, 14B of the side walls of the notch, such that the tube is reasonably firmly and securely held in an upright position. At the same time, it is equally important that the dimensions, especially the top opening width of notch 15 of holder 1 are also sufficient to allow a sufficient length of the folded section of a partially-emptied tube 55 that has been flattened and folded a plurality of times—for toothpaste tubes about four or five times—to be inserted into the notch and to be held securely, without unfolding, in an essentially upright position. For example, a toothpaste tube that has been folded four times is shown in FIG. 4. It is also important that the width of the planar inner surfaces of the notch are sufficient to provide a firm grasp on the inserted tube. However, it is not necessary for the inner surfaces of the notch of the holder to be wider than the width of the inserted tube for it to firmly grasp the tube. The inner surfaces of the notch can be wider than, the same width as, or narrower than the width of the inserted tube. When these dimensions are correctly chosen, a compact, decorative holder can be obtained which enables a tube to be essentially completely emptied without having to be constantly reflattened and refolded. If on the other hand, compactness is not an issue, a larger holder that has a deeper V-shaped notch and a wider opening width across the top of the notch can be used. In this case, all that is necessary is that the tube be grasped firmly at some height within the V-shaped notch such that it is securely held in an upright position. Consequently, there is a fair degree latitude in selecting the dimensions of the height of the notch, the opening width across the top of the notch, and to a lesser degree the small width of the valley of the notch that will enable a holder to hold any given tube in an upright position.

Referring to FIG. 5, a second embodiment of a holding device of the present invention is illustrated in a perspective view of a holder 7 holding a full, squeezable, collapsible dispensing tube 40 in a substantially upright position. Tube 40 comprising flexible, elastic, tubular walls, a nozzle 41 containing a removable cap 42 at one end, defined as the top portion of the tube, and a flat seal 43 at the other end, defined as the bottom portion of the tube. Holder 7 comprising a substantially rigid base comprising two opposing supporting walls 22C, 22D and two substantially rigid side walls 313A, 313B that are in the form of a substantially V-shaped notch 315. Supporting walls 22C, 22D have planar standing surfaces or bottoms 23C, 23D, respectively, that lie in the same horizontal plane. Each supporting wall 22C or 22D has an inner face 24C or 24D, respectively. The inner faces of the supporting walls are aligned so that they are opposed to one another. Each side wall 313A or 313B has a substantially planar holding surface or inner surface 314A or 314B, which may be smooth or scored, or otherwise roughened to improve their holding power, two ends 26A, 27A or 26B, 27B, and a bottom 317A or 317B, respectively. Side wall bottoms 317A, 317B are preferably planar and parallel to the planar bottoms of supporting walls 22C, 22D. Each side wall 313A or 313B is transversely integrally attached at their ends 26A, 27A or 26B, 27B, respectively, to the opposed inner faces 24C, 24D of the supporting walls. Side walls 313A, 313B are aligned so that their inner surfaces 314A, 314B face each other as if they were mirror images. Each planar inner surface 314A or 314B has a substantially linear bottom edge 319A or 319B, respectively. Said bottom edges 319A, 319B are parallel to each other on a plane that is preferably parallel to the planar bottoms of the supporting walls, and are either superimposed on one another, as shown in FIG. 5, or separated from each other by some small predetermined distance, as shown in FIG. 6. As shown in FIG. 5, the inner surfaces rise equally from their bottom edges, separating from each other and equally from the perpendicular to planar bottom standing surface 23C, 23D as they rise, to produce a substantially V-shaped notch 315, whose inner surfaces are substantially the same height, that is closed at each end, such that the notch is of sufficient dimensions that a sufficient length of the bottom portion of a full, collapsible dispensing tube fits into and is grasped firmly by the notch while being securely held in an upright position in the holder. The notch must also be of sufficient dimensions that a sufficient length of the folded section of the dispensing tube, which has been partially emptied, flattened, and folded a plurality of times—generally about four or five times for a toothpaste tube—fits into and is grasped firmly by said notch so that it is prevented from unfolding while being securely held in an upright position in the holder.

Still in FIG. 5, when bottom edges 319A, 319B are substantially superimposed on each other, notch 315 is V-shaped with a valley 320 that is essentially an acute angle. As shown in FIG. 6, when bottoms 319A, 319B are separated by a small predetermined distance, say 1 mm to about 4 mm for holding common size toothpaste tubes, the notch 415 of the holder 8 is slightly truncated and its wider valley 420 is a rectangular open slot. Advantages of holders with the slightly wider open notch are that they are easier to manufacture and to clean.

Referring to FIG. 7, a third embodiment of a holding device of the present invention is illustrated in a perspective view of a holder 9 holding a full, squeezable, collapsible dispensing tube 40 in a substantially upright position. Tube 40 comprising flexible, elastic, tubular walls, a nozzle 41 containing a cap 42 at one end, defined as the top portion of the tube, and a flat seal 43 at the other end, defined as the bottom portion of the tube. Holder 9 comprising a rigid base 512 and two side walls 513A, 513B that are aligned such that their planar holding surfaces or inner surfaces 514A, 514B face each other as if they were mirror images and form a substantially V-shaped notch 515. Base 512 has a planar standing surface, or bottom 516. So long as base 512 has a substantially horizontal planar bottom 516, it may have any of a variety of shapes and sizes which may contain holes or be hollow, as well as solid. Besides a planar inner surface 514A or 514B, each side wall 513A or 513B has two ends 526A, 527A or 526B, 527B, and a bottom 517A or 517B, respectively. One end 527A and 527B of each side wall 513A and 513B, respectively, is integrally attached to a side 28 of base 512 such that side wall bottoms 517A, 517B preferably lie on the same plane as the bottom 516 of the base. Each planar inner surface 514A or 514B, which may be smooth or scored, or otherwise roughened, to improve its holding power, of the side walls has a top edge 521A or 521B, and a substantially linear bottom edge 519A or 519B, respectively. Bottom edges 519A, 519B are parallel to each other, on the same plane as side wall bottoms 517A, 517B, and separated from each other by some small predetermined distance. Still in FIG. 7, the planar inner surfaces rise equally from their bottoms edges, separating from each other and equally from an axis that is perpendicular to planar bottom 516 of base 512 as they rise, to produce a slightly truncated V-shaped notch 515, whose inner surfaces are substantially the same height, with a slightly open, flat valley 520. The V-shaped notch is of sufficient dimensions such that a sufficient length of the bottom section of a full, collapsible dispensing tube fits into and is firmly grasped by the notch whereby the tube is securely held in an upright position in the holder. The notch must also be of sufficient dimensions that a sufficient length of the folded section of the dispensing tube, which has been partially-emptied, flattened, and folded a plurality of times, fits into and is firmly grasped by said notch so that it is prevented from unfolding while being securely held in an upright position in the holder. This embodiment is also suited for being wall mounting.

Referring to FIG. 8, a fourth embodiment of a holding device of the present invention is illustrated in a perspective view of a holder 10 holding a full, squeezable, collapsible dispensing tube 40 in a substantially upright position. Tube 40 comprising flexible, elastic, tubular walls, a nozzle 41 containing a cap 42 at one end, defined as the top portion of the tube, and a flat seal 43 at the other end, defined as the bottom portion of the tube. Holder 10 comprising a rigid base consisting of two opposing supporting walls 722C, 722D that are transversely linked together by two rigid side walls 713A, 713B. Said side walls are integrally attached in the form of a substantially V-shaped notch 715. Each side wall 713A or 713B has a substantially planar holding surface or inner surface 714A or 714B, an outer surface 725A or 725B, and a bottom 717A or 717B, respectively. Planar inner surfaces 714A, 714B at the bottoms 717A, 717B of their side walls 713A, 713B, respectively, are beveled such that they form a V-shaped miter joint 30. These beveled side walls are integrally attached to each other at their mitered bottoms such that the inner surfaces of the side walls face each other as mirror images and form a V-shaped notch 715 whose inner surfaces are substantially the same height. This V-shaped notch is of sufficient dimensions so that a sufficient length of the bottom section of a full dispensing tube fits into and is, firmly grasped by the notch. The V-shaped notch should also be of sufficient dimensions that a sufficient length of the folded section of the dispensing tube, after it has been partially-emptied, flattened, and folded a plurality of times, fits into and firmly grasped by said notch so that it is securely held upright and prevented from unfolding. Supporting walls 722C, 722D have planar standing surfaces or bottoms 723C, 723D, respectively, that lie in the same horizontal plane. Each supporting wall 722C or 722D has an inner face 724C or 724D, an outer face 725C or 725D, and a top 29C or 29D, respectively. The inner faces of the supporting walls are aligned so that they oppose each other. The supporting walls 722D, 722D, at their tops 29C, 29D, are attached to the outer surfaces 725A, 725B of the joined side walls 713A, 713B of the V-shaped notch such that a dispensing tube is held securely in an upright position by the V-shaped notch of the holder.

Having generally described this invention, a further understanding can be obtained by references to certain specific examples which are provided herein for purposes of illustration only and are not intended to be limiting unless otherwise specified.

EXAMPLE 1

This is an example of a very compact device of this invention that is useful for holding either full or flattened and folded smaller toothpaste tubes containing from say 0.65 oz to about 5 or 6 oz of product, which has the same general shape as holder 1, shown in FIG. 1, and the following specific dimensions. The overall height of the holder is 48 mm. This holder has a supporting cylindrical base with a diameter 65 mm and height of 15 mm. The bottoms of the two side walls of the holder are integrally attached to the top of the base such that their planar inner surfaces face each other and form a V-shaped notch. Including the opening of the V-shaped notch, the side walls form a truncated conical shape whose circular bottom is centered on the top of the base and parallel to its bottom. The diameter of the circular bottom of the truncated conical portion of the holder is 48 mm. Parallel to its bottom, the diameter of the circular top of the truncated portion of the holder is 40 mm. The length of the valley of the notch is 48 mm and 2 mm wide. The height of the notch is 33 mm, the top opening width of the notch is 10 mm, and both of the top edges of the notch are 38 mm.

OPERATION OF THE INVENTION

Reference is now made to the figures. The holder, designated 1 in FIG. 1, contains notch 15 into which the bottom portion of a capped, full tube 40, specifically in this case a toothpaste tube, is inserted such that it securely stands upright and perpendicular to the substantially horizontal plane of the bottom 16 of its base 12. To accomplish this, the height of the notch, the top width of the notch, and the width of the valley of the notch are selected such that a sufficient length of full tube 40 fits into and is reasonably, securely held by the notch. To make it easier to insert the bottom section of the tube directly down into the holder, the bottom section of the tube is squeeze to make it as narrow as possible. Once the tube is placed in the holder, manual pressure is applied towards the top portion of the still capped tube to force more product into the bottom section of the tube and create a tight fit between the bottom of tube 40 and inner surfaces 14A, 14B of notch 15. Also during this process, more product is forced into the section of the tube immediately at and just above the top of notch 15, which increases its strength at this critical area of support. The combination of the support from the inner surfaces of the notch and the increased strength of the tube at the top and directly above the notch enables the tube to stand upright even after a fairly large proportion of the product has been extruded from the tube. Alternatively, it is frequently helpful, but generally not necessary, to fold the original sealed end at the bottom of the tube upward onto the tube before placing it in the holder. In this way, the tube is frequently held more tightly and securely by the holder.

Product, specifically in this case toothpaste, is easily extruded from the tube being held upright in the holder of this invention using only one hand. The cap 42 is easily removed from the nozzle 41 of the tube 40 with one hand and either held in the palm of the same hand, or placed on a convenient surface, such as a sink of counter top. Using the same hand, the thumb and forefinger are placed on the tube, preferably toward the top portion of the tube, and squeezed to apply manual pressure to extrude the desired amount of product. At the same time, the receiving surface for the product, specifically in this case the bristled head of a toothbrush, is conveniently held by the other hand at the nozzle to receive the toothpaste. After the desired amount of toothpaste has been extruded onto the bristled head of the toothbrush, the bristled head of the toothbrush is wiped across the top of the nozzle to remove all of the extruded product while, simultaneously, releasing the manual pressure applied to tube 40. In this manner, the gravitational pull on the product, combined with the elasticity of the tube, automatically re-expands the tube which neatly and cleanly pulls product back into the nozzle of the tube. Still using the same hand, cap 42 is replaced on nozzle 41 of the tube. However, it is not necessary to immediately replace the cap because no product oozes out of the upright tube. Thus, the cap can conveniently, efficiently, and cleanly be replaced while brushing the teeth with the other hand.

By always applying manual extrusion pressure on the upper section of the tube, the lower section of the partially-emptied tube just above the notch of the holder will remain relatively full, even after a fairly large proportion of its product has been extruded. Consequently, the tube will continue to be strong in this area, and thus remain upright, even after a considerable proportion of its product has been extruded. However, during use, at some point, the tube will not be filled with enough product to support itself, and it will sag and bend at its weakest point. Typically a relatively high percentage of the available product, say about 30%, is extruded before the tube begins to sag. At this point, the sagging tube is removed from the holder. The bottom portion of the partially-emptied tube is then flattened in the usual way to remove as much product as possible. If the crimped sealed end at the bottom of the tube was folded up during the original insertion of the tube into the holder, it is also unfolded and reflattened at this time. A variable portion, say about 80%, of this flattened section is folded up onto the remaining portion of the flattened section and onto the bottom section of the unflattened filled portion of the tube such that the crease of the fold is approximately parallel to the original bottom of tube 40 to give a tube 45 with one fold tube. The folded tube 45 is placed into the holder by simply sliding the folded end down into the top of the V notch from directly above while holding a top corner section of the fold to prevent it from springing open and unfolding. This is more easily accomplished by inserting one corner of the folded section of the tube into notch 15 at some angle while holding the opposite end of the folded section. Once one corner of the tube is in the notch, the tube is prevented from unfolding and the insertion is completed by releasing the other end of the folded section and rotated it down into the notch. As with the full tube, the partially-emptied, flattened, and folded tube 45 is now held in an upright position, shown in FIG. 9. Now the sharp bend in the crease of the fold is maintained when manual extrusion dispensing pressure is applied to the tube. This prevents product from re-entering the flattened and folded section of the tube.

Product is extruded from folded tube 45 in the same way as described above for a fill tube held in the holder of this invention. As with a full tube, at some point as product is continually removed from the folded tube, tube 45 will not be able to support itself and will sag. Again, the tube is lifted up and out of the holder with one hand, preferably at some angle to the horizontal, so that the other hand may grasp one edge of the previously folded end of the tube to prevent it from unfolding during removal. Since no product has re-entered the folded section of the tube while in the holder, it is now only necessary to remove product from the section of tube 45 that is above the sharp crease of the fold. This is accomplished by squeezing together both the folded section and the partially-emptied section of the tube onto which it was folded to remove as much product as possible. These two sections, now as a unit, are folded up onto the main body of the tube in the same way as the original folding to give a tube 50 that has been flattened and folded twice, shown in FIG. 10. Alternatively, after tube 45 has been removed from the holder, it may be completely unfolded and reflattened. This flattened section can then be refolded using the same, larger, or smaller size folds than the original fold in a manner similar to that described above for folding the flattened portion of tube 40. Tube 50 is reinserted into holder 1 in the same manner as described above for tube 45. Now tube 50 is again securely held in an upright position where it is used in the same manner as described above for tube 45 and tube 40. In the holder, the creases and the two folds of tube 55 are firmly held in place. This in turn prevents product from flowing back into either of the folded sections during use.

Repeating the process described above, the cycle of flattening and folding continues until the tube is emptied of its product. Generally, the top opening width of the notch of the holder is preselected to hold both a full tube, in particular a toothpaste tube, and the same tube after it has been partially-emptied, flattened, and folded about four times, as shown in FIG. 4. However, if during this flattening and folding process, the folds have been made too small, so that too many folds exist and the multi-folded tube is too wide to fit into the top of the notch of the holder, it is necessary to decrease the number of folds by increasing their length. In this case, the tube is removed from the holder, unfolded, reflattened, refolded using longer folded sections, and reinserted into the holder as described above. Conversely, depending on the size of the tube and the length of the folds, a tube may only need to be folded once or twice to be completely emptied.

CONCLUSIONS, RAMIFICATIONS, AND SCOPE

Accordingly, the reader will see that the collapsible tube holder of this invention is very versatile, compact, decorative, economical, and extremely easy-to-use since it will hold a variety of different-size collapsible tubes, either full or partially-emptied and folded, conveniently in an upright position. Because this device holds a tube in the upright position, gravity assists in making it easier to extrude only the desired amount of product from the tube. A major advantage of this is that the cap and nozzle portion of the tube can more easily be kept clean. Also because of the upright position of the tube, this device enables the user to efficiently extrude product from a tube using only one hand. This holder also greatly increases efficiency by decreasing the number of times the tube must be reflattened and refolded in the process of emptying the tube.. Since this holder is compact, attractive, and can easily be kept clean, it can be left on sink, counter tops, or mounted on a wall, in plain view. Furthermore, the device is easily and economically manufactured out of a variety of materials in attractive colors and shapes to enhance household decor.

Although particular embodiments of the present invention have been disclosed, it should be understood that these are meant only to provide illustrations of the currently preferred embodiments and not to limit the scope of this invention. It would be obvious to those skilled in the art that various other changes and modifications may be made without departing from the broader aspects of this invention. Consequently, it is desired that the appended claims and their legal equivalents cover all such changes and modifications as fall within the true spirit and scope of this invention.

I claim:

1. A combination of a removable and reusable holder and an elongated, collapsible dispensing tube for containing squeezable product, said tube comprising:

collapsible, flexible, tubular walls, a capped nozzle at one end through which the contents of the tube are emptied, defined as the top portion, and a flat seal at the other end, defined as the bottom portion, adaptable to be repeatedly flattened and folded upward from said flat seal into increasingly larger folds until substantially the entire length of said tube may be flattened and folded, said holder comprising:

a substantially rigid supporting base having a substantially planar bottom standing surface, two substantially rigid side walls, each said side wall has a bottom integrally attached to the top of said base, each said side wall has a substantially planar inner surface, said planar inner surfaces face each other as if they were mirror images, each of said planar inner surfaces has a substantially linear bottom edge that lies on said base, said bottom edges are preferably on a plane which is parallel to said bottom standing surface of said base, said bottom edges are preferably parallel to each other, said planar inner surfaces of said side walls rise equally from said bottom edges, separating from each other and equally from an axis which is perpendicular to said bottom standing surface as they rise, to produce a substantially upright V-shaped notch that is open on each end, said planar inner surfaces are substantially the same height, said notch is of sufficient dimensions that a sufficient length of said bottom portion of a full said dispensing tube fits into and is firmly grasped by said notch so that it is securely held in an upright position, said notch is also of sufficient dimensions that a sufficient length of a folded section of said dispensing tube that has been partially-emptied, flattened, and folded a plurality of times, fits into and is firmly grasped by said notch so that it is prevented from unfolding while being securely held in an upright position.

2. The combination according to claim 1 wherein the substantially planar inner surfaces of the V-shaped notch are scored.

3. A combination of a removable and reusable holder and an elongated dispensing tube for containing squeezable product, said tube comprising:

collapsible, flexible, tubular walls, a capped nozzle at one end through which the contents of the tube are emptied, defined as the top portion, and a flat seal at the other end, defined as the bottom portion, adaptable to be repeatedly flattened and folded upward from said flat seal into increasingly larger folds until substantially the entire length of said tube may be flattened and folded, said holder comprising:

a substantially rigid supporting base comprising two supporting walls, said supporting walls have a substantially planar bottom standing surface that lie in the same plane, each said supporting wall also possesses an inner face, said supporting walls are aligned so that said inner faces face each other, two substantially rigid side walls, each said side wall has a bottom, two ends, and a substantially planar inner surface, said side walls are transversely integrally attached at their said ends to said inner faces of said supporting walls, said planar inner surfaces of said side walls face each other as if they were mirror images, each said planar inner surface has a substantially linear bottom edge at each said bottom of each said side wall, said bottom edges lie in the same plane that is preferably parallel to the plane of said bottoms of said supporting walls, said bottom edges are also preferably parallel to each other, said planar inner surfaces of said side walls rise equally from said bottom edges, separating from each other and equally from an axis that is perpendicular to said bottom standing surface as they rise, to produce a substantially upright V-shaped notch that is closed at each end, said planar inner surfaces are substantially of the same height, said notch is of sufficient dimensions that a sufficient length of the bottom portion of a full said dispensing tube fits into and is firmly grasped by said notch so that it is securely held in an upright position, said notch is also of sufficient dimensions that a sufficient length of the folded section of said dispensing tube, which has been partially-emptied, flattened, and folded a plurality of times, fits into and is firmly grasped by said notch so that it is prevented from unfolding while being securely held in an upright position.

4. The combination according to claim 1 wherein the valley of the notch is a narrow, open, rectangular slot.

5. A combination of a removable and reusable holder and an elongated, dispensing tube for containing squeezable product, said tube comprising:

collapsible, flexible, tubular walls, a capped nozzle at one end through which the contents of the tube are emptied, defined as the top portion, and a flat seal at the other end, defined as the bottom portion, adaptable to be repeatedly flattened and folded upward from said flat seal into increasingly larger folds until substantially the entire length of said tube may be flattened and folded, said holder comprising:

a substantially rigid base having a substantially planar bottom standing surface, two substantially rigid side walls, each said side wall has a bottom that lies on the same plane as said bottom standing surface of said base, two ends, a substantially planar inner surface, and an outer surface, each said side wall is integrally attached at one said end to a side of said base such that said planar inner surfaces of said side walls face each other as if they were mirror image, said planar inner surfaces have substantially linear bottom edges at said bottoms of said side walls, said linear bottom edges are preferably parallel to each other, said planar inner surfaces of said side walls rise equally from said bottom edges, separating from each other and equally from an axis which is perpendicular to said bottom standing surface as they rise, to produce a substantially upright V-shaped notch that is closed at one end, said planar inner surfaces are substantially the same height, said notch is of sufficient dimensions that a sufficient length of the bottom portion of a full said dispensing tube fits into and is firmly grasped by said notch so that it is securely held in an upright position, said notch is also of is also of sufficient dimension that a sufficient length of the folded section of said dispensing tube that has been partially-emptied, flattened, and folded a plurality of times fits into and is firmly grasped by said notch so that it is prevented from unfolding while being securely held in an upright position.

6. The combination according to claim 1 wherein the valley of the notch is a narrow, open, rectangular slot.

7. The combination according to claim 1 wherein the substantially planar inner surfaces of the V-shaped notch are scored.

8. A combination of a removable and reusable holder and an elongated dispensing tube for containing squeezable product, said tube comprising:

collapsible, flexible, tubular walls, a capped nozzle at one end through which the contents of the tube are emptied, defined as the top portion, and a flat seal at the other end, defined as the bottom portion, adaptable to be repeatedly flattened and folded upward from said flat seal into increasingly larger folds until substantially the entire length of said tube may be flattened and folded, said holder comprising:

two side walls, each said side wall has a substantially planar inner surface, an outer surface, and a bottom, said planar inner surfaces at said bottoms of said side walls are beveled such that they form a miter joint such that said planar inner surfaces face each other and form a V-shaped notch, said planar inner faces are substantially the same height, said side walls are integrally attached to each other at said miter joint, said V-shaped notch is of sufficient dimensions so that a sufficient portion of the bottom section of a full dispensing tube fits into and is firmly grasped by the V-shaped notch, said V-shaped notch is also of sufficient dimensions such that a sufficient length of the folded section of the dispensing tube that has been partially-emptied, flattened, and folded a plurality of times fits into and is firmly grasped by said V-shaped notch so that it is prevented from unfolding, a substantially rigid base comprised two supporting walls, each said supporting wall has a top, a planar bottom standing surface, and an inner face, said bottom standing surfaces lie on the same plane, said inner faces of said supporting walls are aligned so that they oppose each other, said tops of said supporting walls are attached to said outer surfaces of said side walls such that said dispensing tube is securely held in an upright position by said V-shaped notch.

* * * * *